US005435485A

United States Patent [19]

Atterbury

[11] Patent Number: 5,435,485

[45] Date of Patent: Jul. 25, 1995

[54] AUTOMATIC PURGE SYSTEM FOR GAS ENGINE HEAT PUMP

[75] Inventor: William G. Atterbury, Columbus, Ohio

[73] Assignee: Gas Research Institute, Chicago, Ill.

[21] Appl. No.: 98,133

[22] Filed: Jul. 26, 1993

Related U.S. Application Data

[63] Continuation-in-part of Ser. No. 90,512, Jul. 12, 1993, Pat. No. 5,363,673, which is a continuation-in-part of Ser. No. 919,037, Jul. 24, 1992, Pat. No. 5,249,742.

[51] Int. Cl.[6] ..... F25B 27/00; G05D 23/00

[52] U.S. Cl. ..... 237/2 B; 62/323.1; 237/12.3 B

[58] Field of Search ..... 237/12.3 B, 66, 2 B; 123/41.27; 62/324.1, 323.1, 238.6

[56] References Cited

U.S. PATENT DOCUMENTS

| | | | |
|---|---|---|---|
| 2,841,127 | 7/1958 | Baster | 123/41.1 |
| 2,878,794 | 3/1959 | Stromberg | 123/41.27 |
| 3,601,181 | 8/1971 | Avrea | 165/1 |
| 4,545,335 | 10/1985 | Hayashi | 123/41.27 |
| 4,549,505 | 10/1985 | Hirano | 123/41.08 |
| 4,574,747 | 3/1986 | Hirano | 123/41.27 |
| 4,577,594 | 5/1986 | Hayasahi et al. | 123/41.08 |
| 4,646,688 | 3/1987 | Hirano et al. | 123/41.27 |
| 4,648,357 | 3/1987 | Hayashi | 123/41.27 |
| 4,662,317 | 5/1987 | Ogawa | 123/41.21 |
| 4,677,942 | 7/1987 | Hayashi | 123/41.21 |
| 4,721,071 | 1/1988 | Fujigaya et al. | 123/41.21 |
| 4,788,943 | 12/1988 | Hayashi | 123/41.27 |
| 5,249,742 | 10/1993 | Atterbury et al. | 237/2 B |

*Primary Examiner*—Henry C. Yuen

*Attorney, Agent, or Firm*—Watkins, Dunbar & Pollick

[57] ABSTRACT

A heat engine driven heat pump system including a coolant fluid circulation subsystem further includes an automatic purge system to provide purging of air gases and vapors during initial filling and subsequent on-line operation to eliminate trapped and accumulated gases and vapors which decrease heat pump system efficiency and reliability, and interfere with waste heat recovery.

18 Claims, 2 Drawing Sheets

AUTOMATIC PURGE SYSTEM FOR GAS ENGINE HEAT PUMP

CROSS-REFERENCE TO RELATED APPLICATIONS

This is a continuation-in-part of U.S. patent application Ser. No. 08/090,512, filed Jul. 12, 1993, entitled "Simplified Engine Coolant System for Gas Engine Heat Pump", now U.S. Pat. No. 5,363,673, issued Nov. 15, 1994; which is itself a continuation-in-part of U.S. patent application Ser. No. 07/919,037, filed Jul. 24, 1992, entitled "Coolant Circulation System for Engine Heat Pump", now U.S. Pat. No. 5,249,742, issued Oct. 5, 1993; the disclosures of which are hereby incorporated by reference.

FIELD OF THE INVENTION

This invention relates to a method and system for purging the engine coolant and waste heat recovery subsystem in an engine driven heat pump system. In particular, it relates to a method and apparatus for purging trapped non-condensable gases and vapor pockets in the engine coolant system and heat recovery components of a gas engine driven heat pump system which is used primarily to control the internal environment and comfort condition in the living quarters and working space of a structure.

BACKGROUND OF THE INVENTION

Broadly speaking, heat engine driven heat pump systems are well known and have been refined for internal space conditioning use as shown in U.S. Pat. No. 4,991,450. Because heat engines, such as natural gas driven internal combustion engines, provide excess and otherwise unused heat in the motive process, subsystems have been developed which recapture otherwise waste heat which is circulating in the engine coolant. U.S. Pat. Nos. 5,003,788, 5,020,320, 5,029,449, and 5,099,651 are further examples of this type of subsystem.

Further improvements in these subsystems provide advantages in waste heat recovery to the application of such heat to the occupants of the space and in some instances for other purposes, such as domestic water heating.

Traditionally heat pumps such as electric motor-driven heat pumps do not have sufficient excess available heat for use in such subsystems. Thus, waste heat recovery components are not included in electric motor-driven heat pumps.

Further refinements and improvements in waste heat recovery subsystems are important since they increase the overall coefficient of performance (COP) of the heat pump system as well as providing overall operational economies by reducing the amount of externally supplied auxiliary heat and increase the comfort of the delivered air. Waste heat recovery is possible, however, only if necessary coolant flow to the engine is provided to receive the waste heat, and the necessary coolant flow to heat recovery components is maintained when and where needed to deliver waste heat to desired loads.

It has been found through testing that pockets of air and vapor may become trapped or accumulate in various locations in the engine coolant and heat recovery subsystem. Trapped air gases and vapors can result from initial filling, or can accumulate during system operation from entrainment in the circulating fluid.

Regardless, the resulting pockets of trapped air and vapor inhibit and interfere with necessary coolant flow for engine cooling and waste heat recovery, preventing efficient waste heat recovery and use.

For example, trapped air and vapor pockets can prevent adequate purging upon initial coolant charging of the subsystem, resulting in subsystem overheating during operation. To overcome this problem, the initial purge process has become more involved and more time-consuming than desirable, for example, requiring rapid flushing and repeated manual venting, adding to overall system operating costs. However, in some systems, complete purging of gases and vapors from the coolant is not possible, and entrained gases and vapors continue to accumulate during operation. Further, where present, trapped air and vapor pockets can cause increased operating temperatures, resulting in long-term coolant degradation and reduced coolant life, impacting overall heat pump system reliability. Ultimately, trapped air and vapor pockets in high points of subsystem lines and components, often remote and elevated relative to the heat engine, can prevent the pump from providing adequate coolant flow, impacting not only the delivery of waste heat, but return coolant flow to the engine. In such cases, engine driven pumps have been found to have insufficient static pressure capabilities to overcome air and vapor pockets, for example, pockets trapped or accumulated in the coolant line to the indoor coil, especially where the engine is operating at low speeds.

While this invention is described herein in association with a gas fueled internal combustion engine, broader applications to other "heat" engines, such as turbines, may be possible. The coolant fluid employed in the subsystem may be one of various conventional types, such as an ethylene glycol-water mixture or a propylene glycol-water mixture.

Accordingly, the need exists for improved engine coolant circulation systems to improve coolant circulation, waste heat recovery, and operating efficiencies of such engine-driven heat pump systems.

SUMMARY OF THE DISCLOSURE

The present invention satisfies that need by providing an automatic purge system for the coolant circulation subsystem of a heat engine-driven heat pump system which facilitates both more cost-effective initial purging, and continued on-line purging to maintain system operating efficiencies. More specifically, the invention relates to a heat-engine driven heat pump system comprising: a refrigeration cycle heat pump compressor driven by a heat engine; an engine coolant subsystem including circulation conduit for coolant fluid flow to and from both the engine and at least one waste heat recovery component where waste heat may be applied to a load; and a purge system.

In accordance with the present invention, the purge system automatically vents or purges purge points periodically throughout the engine coolant subsystem and waste heat recovery components, eliminating trapped and accumulated gases and vapors. The purge system thereby promotes improved coolant flow, reduced operating temperatures, and allows the heat pump system and waste heat recovery components to operate with greater efficiency and higher reliability.

The purge system may incorporate a number of other features including vacuum tight valves, a central manifold, and a triggering device to initiate sequential, periodic automatic operation of the valves.

The foregoing and other advantages of the invention will become apparent from the following disclosure in which the preferred embodiment of the invention is described in detail and illustrated in the accompanying drawings. It is contemplated that variations in the procedures, structural features and arrangement of parts may appear to those skilled in the art without departing from the scope or sacrificing any of the advantages of the invention.

DETAILED DESCRIPTION OF THE PREFERRED EMBODIMENTS

Figure 1:
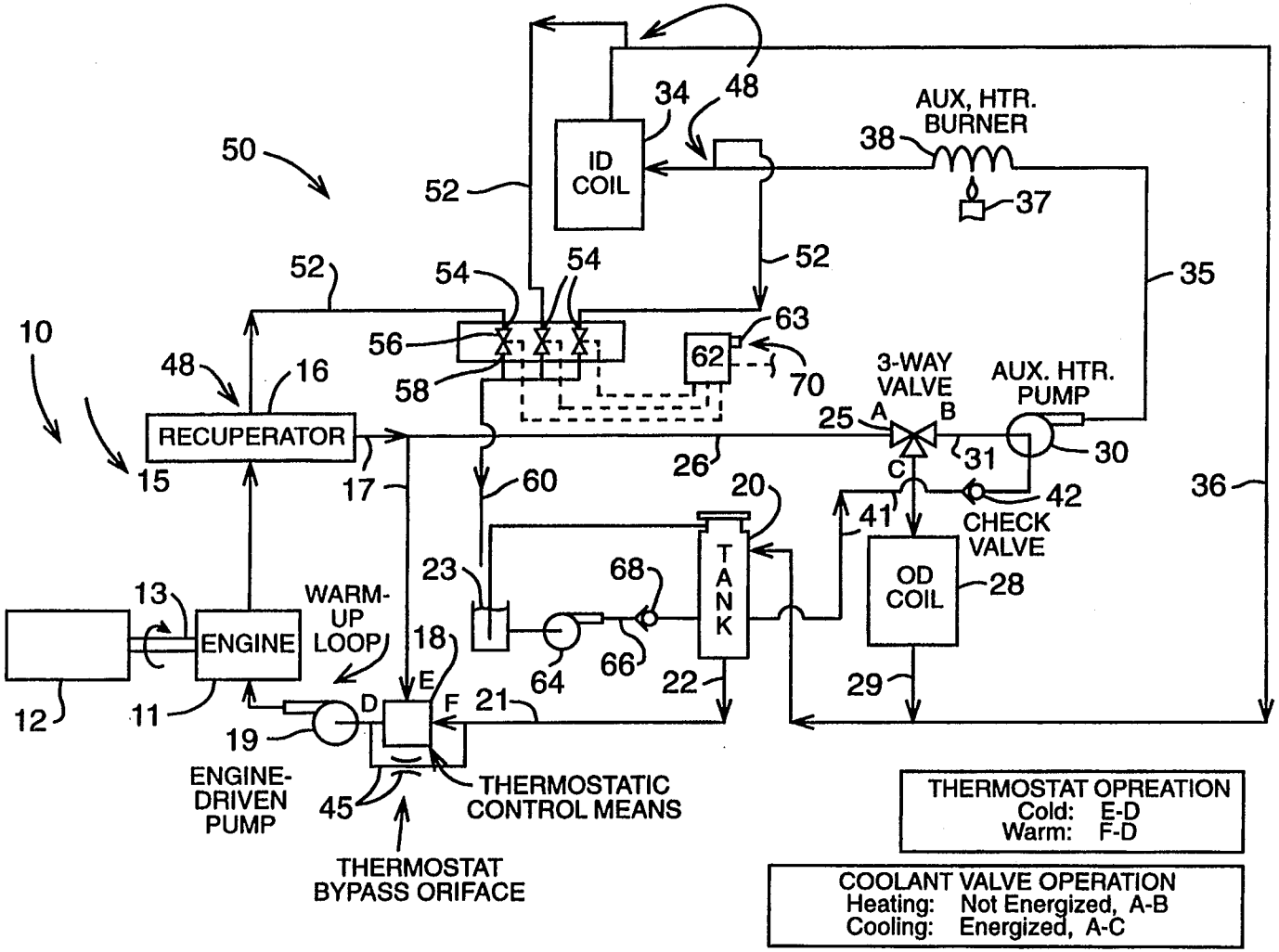
FIG. 1 is a schematic drawing of a representative heat pump system and coolant fluid circulation subsystem including the purge system of the present invention.
Figure 2:
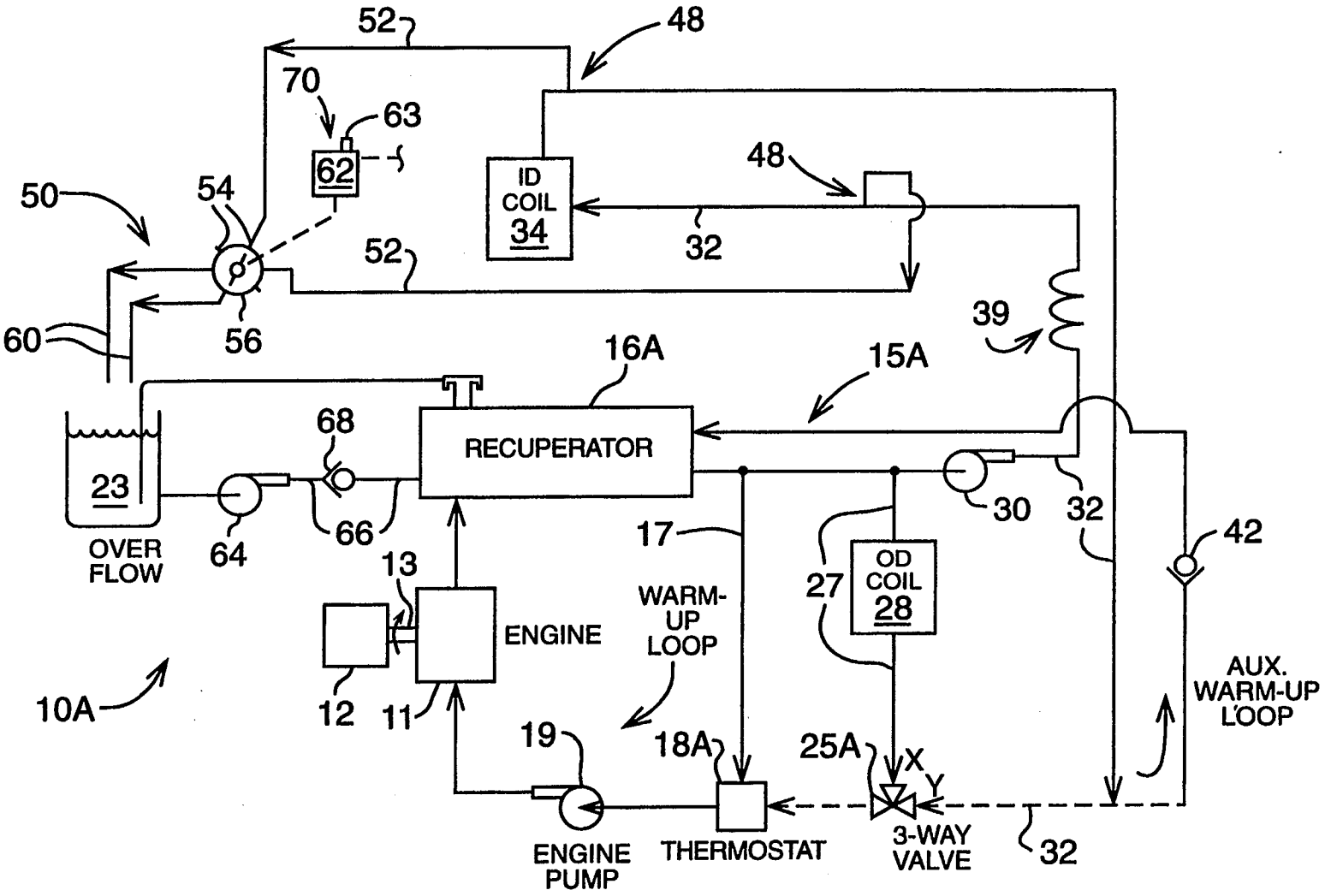
FIG. 2 is a schematic drawing of another representative heat pump system and simplified coolant fluid circulation subsystem including the purge system of the present invention.

Two illustrative heat pump systems are shown in FIGS. 1 and 2 to illustrate the operation and advantages of the purge system of the present invention. It is understood, however, that the purge system 50 may be generally applied to any heat pump coolant fluid circulation subsystem to provide initial and continuing purging of non-condensable air gases and vapors from points system lines and components, where needed, to improve overall operation and performance of the heat pump systems.

It is further understood that the details and advantages of the illustrative heat pump systems and coolant subsystems of FIGS. 1 and 2 are more completely set forth in U.S. Pat. No. 5,249,742 and U.S. Pat. No. 5,363,673, cited in the first paragraph herein, which are all commonly assigned, and incorporated herein by reference. Although the representative heat pump systems are briefly described below, the purge system 50 of the present invention may be applied to heat pump systems having more or less components, in similar or different configurations than those shown herein. Thus, for purposes of the present invention, it is sufficient to understand that coolant fluid circulates through the various lines, conduits and components in different modes, and that gases and vapors trapped in the subsystem and carried by the coolant tend to accumulate into pockets at identifiable points or positions, often the subsystem high points. Such pockets decrease heat pump system efficiency and reliability, and interfere with waste heat recovery. The points or positions at which such pockets exist are referred to herein as purge points 48.

Purge System

As representatively shown in the embodiments of FIGS. 1 and 2, the heat pump system 10, 10A generally includes a refrigeration cycle heat pump compressor 12 driven by a heat engine means 11, and a coolant fluid circulation subsystem 15, 15A. Generally, the subsystems include circulation conduit means to circulate coolant fluid flow to and from the engine 11 and to and from at least one waste heat recovery component, and at least one waste heat recovery component at which waste heat may be applied to a load. The fluid is circulated by a first pump means 19 to convey coolant fluid under pressure through the circulation conduit means, engine 11, and heat recovery component. An overflow reservoir 23 is provided to receive excess coolant fluid from the conduit means during subsystem operation and return coolant fluid during subsystem cooldown. The subsystem further includes a plurality of purge points 48, at which non-condensable gases and vapors can become trapped or accumulate.

In accordance with the present invention, the heat pump system 10, 10A further includes a purge system 50 having a plurality of vent lines 52 each extending from one of a plurality of purge points 48 in the subsystem to respective inlets 54 of at least one purge valve 56. The purge valve 56 has at least one inlet 54 and at least one outlet 58, and is preferably a vacuum tight valve to prevent air in-leakage into the conduit means and during subsystem cooldown. The purge valve 56 may be a multi-port valve selectably adjustable to different vent lines attached to ones of a plurality of inlets 54 (see FIG. 2). Alternatively, a plurality of purge valves 56 may be provided connected to ones of the vent lines 52, with the purge valves 56 preferably manifolded together to centralize operation, and simplify control (see FIG. 1). The purge valves are automatically operable by air or electric operators. To return condensable vapors and coolant fluid to the system, a drain conduit means 60 is provided to receive the flow of air, vapor or fluid from the purge valves 56 and convey it to the overflow reservoir 23. The overflow reservoir 23 is preferably at atmospheric pressure, and air gases and vapors are released there to the atmosphere, while fluid drains into the overflow reservoir 23. The drain conduit means 60 may be separate lines extending from the purge valve outlets 58, or a single line extending from an outlet manifold 59. The purge system 50 further includes a processor means 62 for operating the purge valve or valves 56 to purge trapped air and vapor from the plurality of purge points 48 through the plurality of vent lines 52 to the overflow reservoir 23. Finally, a purge pump 64 and return conduit means 66 convey coolant fluid under pressure from the overflow reservoir 23 through a check valve 68 back into circulation in the subsystem where the circulating fluid is maintained during circulation at a higher pressure.

In accordance with the present invention, the processor means 62 automatically operates the purge valve or valves 56 to sequentially purge from the purge points 48, and thus permits purging during initial filling as well as routinely during operation. To this end, the purge system preferably further includes a purge trigger means 70 to periodically produce a trigger signal received by the processor means 62, to initiate an automatic sequential purge of the purge points. Such purge trigger means 70 may be a timer 63 preferably incorporated into the processor means 62, a fluid level sensor (not shown) which senses fluid level at some point in the subsystem, such as at a purge point, a flow sensor (not shown) to detect reduced fluid flow, a temperature sensor (not shown) to detect coolant overheating, or a combination thereof. The purge trigger means 70 may also be provided by a central heat pump control system, and the processor means 62 may be separate from or incorporated into such a central heat pump control system.

In the subsystem 15, 15A, purge points 48 are typically found at subsystem high points in the circulation conduit means, such as in inside conduits which are elevated, or at high points in waste heat recovery components. However, purge points 48 may also be identified at various points in the circulation conduit means or in a heat recovery component where air or vapor is trapped or accumulates, and inhibits coolant flow.

Heat pump systems may incorporate various heat recovery components, depending on the particular application. Thus, in accordance with the present invention, by way of illustration and not limitation, heat recovery components may be components such as the recouperator means 16, 16A; an indoor heat exchanger 34 in heat exchange relation to a heating or cooling load; an outdoor heat exchanger having a defrosting loop, such as shown in Fischer, U.S. Pat. No. 5,003,788, issued Apr. 2, 1991, the disclosure of which is hereby incorporated by reference; a hot water tank heat exchanger, also shown in the '788 patent; or a swimming pool heat exchanger, not shown, but similar to the hot water tank heat exchanger.

In operation, the method for purging the coolant fluid circulation subsystem may be summarized as including the initial step of identifying a plurality of purge points 48 in the coolant fluid circulation subsystem. Next, the method requires providing a plurality of vent lines 52 each extending from ones of the purge points 48 to respective purge valve inlets 54, at least one purge valve 56, having at least one inlet 54 and at least one outlet 58, at least one drain conduit means 60 extending from at least one purge valve outlet 58 to the overflow reservoir 23, a processor means 62 for operating the one purge valve, and a purge pump 64 and return conduit means 66 to convey coolant fluid under pressure from the overflow reservoir 23 into circulation in the subsystem. The method then calls for automatically venting ones of the purge points 48 to the overflow reservoir 23, the step of automatically venting including the step of automatically operating at least one vent valve 56 to open ones of the vent lines 52 to purge trapped air and vapor from the purge points 48. The final step is returning coolant fluid under pressure into circulation in the subsystem to maintain subsystem fluid volume at a desired level.

Preferably, the step of automatically venting includes triggering the processor means 62 periodically to sequentially vent the plurality of purge points 48.

Illustrative Embodiments of the Heat Pump System

To facilitate understanding of the present invention, the overall structure and operation of two alternative embodiments of the heat pump systems 10, 10A will be summarized with reference to FIGS. 1 and 2. Referring to FIG. 1, a heat pump system, referred to generally as 10 includes a heat engine 11 mechanically connected to a refrigerant cycle compressor 12 by a mechanical rotational means 13. The engine 11 is preferably a natural gas fueled internal combustion engine, but there could be other types of heat engines to which the invention would be applicable and useful.

The compressor means 12 of the heat pump system 10 is preferably of the vapor compression refrigeration cycle type that is employed in a conventional heat pump system constructed to provide cooling and dehumidifying at an indoor heat exchanger coil in a cooling mode of operation; or to provide heat to a load in a heating mode of operation, with heat pumping from an outdoor heat exchanger which operates to exchange heat with outside ambient air as a source of heat or a heat sink.

A coolant fluid circulation subsystem is indicated generally as 15 and provides additional heating or cooling to the total heat pump system by capturing heat from the engine 11 that is generated in the combustion process but not used to drive the compressor 12. This so-called waste heat is captured from the engine itself and from a recouperator 16 which is connected to the engine. The recouperator 16 receives a coolant fluid flowing through a network of connections and conduits to be further described. The recouperator 16 may be a muffler of the engine 11 or other mechanical component of the engine capable of radiating and exchanging heat to the coolant fluid.

The network of connections and conduits further includes a thermostatic coolant fluid control means 18 which is connected to receive and control the coolant fluid flow to a first pump means 19 and thence return to the engine 11.

The recouperator 16, a connection 17, thermostatic control means 18, and first pump means 19 constitute a coolant fluid "loop" circuit hereafter termed the warm-up loop.

A coolant fluid reservoir means 20, shown in the form of a tank, is connected to an inlet 21 of the control means 18 by a connection 22. The reservoir means 20 is maintained replenished as necessary from an ambient overflow tank 23. The thermostatic control means 18 is operable to warm or control the engine temperature by modulating flow between coolant fluid from the warm-up loop or from the reservoir 20.

Further in the subsystem 15, a coolant fluid switching valve means 25 is connected to the recouperator 16 by a conduit connection 26. A first heat exchanger 28 is connected to an outlet of a switching valve means 25. The first heat exchanger 28 is in heat exchange relation to a heat source or sink, such as outdoor ambient air. First heat exchanger 28 is connected by connections 29 to the reservoir means 20.

A second pump means 30 is connected to the coolant fluid switching valve means 25 by a connection 31. In the normal heating mode, coolant is flowed through the second pump means 30 by the first pump means 19. Coolant is then flowed through the auxiliary heater 38 and to the second heat exchanger 34 through connection 35, from which it is returned to the reservoir means 20 through connection 36. By way of example, the auxiliary heater may be a gas burner 37, in association with a heat exchange coil 38.

Referring now to FIG. 2, where like numbers represent like elements, the heat pump system is referred to generally as 10A.

The second embodiment of the present invention also includes a coolant fluid circulation subsystem, indicated generally as 15A, which provides additional heating or cooling to the total heat pump system by capturing heat from the engine 11 that is generated in the combustion process but not used to drive the compressor 12. As in the first embodiment, the waste heat is captured from the engine 11 in a recouperator 16A which is connected to the engine 11. However, in the second embodiment, the recouperator 16A is redesigned with an increased fluid volume to replace the coolant fluid reservoir 20 of the first embodiment (see FIG. 1). Thus, in the second embodiment, the recouperator 16A both receives and supplies coolant fluid flowing through a network of connections and conduits. The recouperator means 16A is maintained replenished as necessary from an ambient overflow tank 23 connected at its fill port.

As shown in FIG. 2, a thermostatic coolant fluid control means 18A is connected to receive and control the coolant fluid flow from recouperator 16A.

In the second embodiment of FIG. 2, the recouperator 16A, a connection 17, thermostatic control means 18A, and first pump means 19 function as a warm-up loop.

The thermostatic control means 18A is also operable to warm or control the engine temperature by modulating flow between coolant fluid from the warm-up loop or from a switching valve 25A.

The switching valve 25A provides coolant fluid from either a first conduit means 27 which includes a first heat exchanger 28 (the outdoor heat exchanger or outdoor coil), or a second conduit means 32 which includes a second heat exchanger 34 (the indoor heat exchanger or indoor coil).

In addition, as in the first embodiment, the second embodiment includes a second pump means 30 and an auxiliary heating means 39 positioned in series with the indoor second heat exchanger 34. A third cirulation conduit means is provided to return heated coolant fluid through a check valve 42 to the second heat exchanger 34 by selective operation of the second pump means 30 and auxiliary heating means 39. In some configurations, check valve 42 may be omitted.

Although not shown in either FIGS. 1 or 2, the engine is provided with the usual combustion and ignition controls which operate by sensing and responding to load conditions in the conditioned space environment with which the heat pump system 10A is associated.

In both illustrative embodiments, in most circumstances, during the cooling mode of operation, except during warm-up, coolant fluid will circulate under the influence of first pump means 19 through the outdoor first heat exchanger 28 and the warm-up loop will be closed by the thermostatic control means.

In both embodiments, in the normal heating mode, coolant is flowed through the second pump means 30 by the first pump means 19 to the auxiliary heating means, and thence to the second heat exchanger 34.

Finally, in both embodiments, in the heating mode of operation selective and controlled operation of the second pump means 30 and the auxiliary heating means, supplies additional heat to the coolant fluid to increase the supply of heat at the second heat exchanger 34 and to the load.

Application of the purge system 50 of the present invention to the coolant fluid circulation subsystems, such as shown in FIGS. 1 and 2, preferably does not require that active circulation be established in the conduit to be purged at the time of purging. Rather, it is only necessary that fluid pressure be present in the particular conduit, and that additional fluid be available to fill relieved portions of the conduit. As may be understood from FIGS. 1 and 2, the representative subsystem conduit means are pressurized by the first pump 19 regardless of the positions of the valves 25, 25A, and it is not necessary to manipulate the subsystem operation to produce flow to provide purging at purge points 48. The first pump 19 is able to supply additional fluid to a conduit even where the subsystem is not being operated to provide flow therethrough. In some heat pump systems, the various flow patterns established by the conduit means may require manipulation of subsystem flow paths to pressurize the conduit being purged. Operation of a heat pump subsystem in this manner to achieve the intended result is within the scope of the purge system contemplated herein, and it is understood that sequential operation of the purge valves 56 will be coordinated with operation of other subsystem valves by, for example, processor means 62, to provide purging.

It is herein understood that although the present invention has been specifically disclosed with the preferred embodiments and illustrative examples, modifications and variations of the concepts herein disclosed may be resorted to by those skilled in the art. Such modification and variations are considered to be within the scope of the invention and the appended claims.

What is claimed is:

1. A heat engine driven heat pump system comprising:

a) a refrigeration cycle heat pump compressor driven by a heat engine means;

b) a coolant fluid circulation subsystem including:

A) circulation conduit means to circulate a coolant fluid flow to and from the engine and to and from at least one waste heat recovery component;

B) at least one waste heat recovery component at which waste heat may be applied to a load;

C) a first pump means to convey coolant fluid under pressure through the circulation conduit means, engine, and heat recovery component;

D) an overflow reservoir to receive excess coolant fluid during subsystem operation and return coolant fluid during subsystem cooldown; and E) a plurality of purge points; and c) a purge system including:

A) a plurality of vent lines each extending from one of a plurality of purge points in the subsystem to respective purge valve inlets;

B) at least one purge valve having at least one inlet and at least one outlet;

C) at least one drain conduit means to receive flow from the at least one purge valve outlet and convey flow to the overflow reservoir;

D) processor means for operating said at least one purge valve to purge trapped air and vapor from the plurality of purge points through the plurality of vent lines to the overflow reservoir; and E) a purge pump and return conduit means to convey coolant fluid under pressure from the overflow reservoir through a check valve into circulation in the subsystem.

2. The heat pump system of claim 1 wherein the processor means automatically operates at least one purge valve to sequentially purge from the purge points.

3. The heat pump system of claim 2 wherein:

the purge system further includes a purge trigger means which periodically produces a trigger signal; and the processor means receives the trigger signal and in response thereto initiates an automatic sequential purge of the purge points.

4. The heat pump system of claim 3 wherein the purge trigger means is selected from the group consisting of: a timer; a fluid level sensor; a flow sensor; a temperature sensor; or a combination thereof.

5. The heat pump system of claim 1 wherein the purge system includes a plurality of purge valves, and ones of the plurality of vent lines are connected to the inlet of respective ones of the purge valves.

6. The heat pump system of claim 5 wherein the plurality of purge valves are grouped in a purge valve manifold and the processor means sequentially operates the plurality of purge valves to sequentially purge from the purge points.

7. The heat pump system of claim 1 wherein the purge system includes at least one purge valve having a plurality of inlets connected to a corresponding plurality of the vent lines, respectively.

8. The heat pump system of claim 1 wherein the overflow reservoir is at ambient atmospheric pressure, and the circulating fluid is maintained during circulation at a higher pressure.

9. The heat pump system of claim 1 wherein each purge point is a location in the subsystem selected from the group consisting of: a high point in the circulation conduit means; a high point in a waste heat recovery component; an identified point in the circulation conduit means where air or vapor accumulates and inhibits coolant flow; or an identified point in a heat recovery component where air or vapor accumulates and inhibits coolant flow.

10. The heat pump system of claim 1 wherein the heat recovery component is selected from the group consisting of: a recouperator means included in the subsystem in fluid connection with the heat engine to receive coolant fluid flow from the engine and engine exhaust gas in heat exchange relation therewith; an indoor heat exchanger in heat exchange relation to a heating or cooling load; a defrosting loop in heat exchange relation with an outdoor heat exchanger; a hot water tank heat exchanger; or a swimming pool heat exchanger.

11. The heat pump system of claim 1 wherein the coolant fluid subsystem further includes:

a recouperator means in fluid connection with the heat engine to receive coolant fluid flow from the engine;

a thermostatic coolant fluid control means receiving and controlling at least a portion of the fluid flow from the recouperator means in response to the temperature of the coolant fluid, the thermostatic coolant fluid control means further positioned to control and convey at least a portion of the coolant fluid flow to the first pump means and to the engine, and complete a first loop circuit operable by the control of the thermostatic means to warm or cool the engine more rapidly when the subsystem operation will benefit therefrom;

a switching valve means to selectively control the flow of at least a portion of the coolant fluid to at least one waste heat recovery component in at least one mode of operation; and a second pump means and an auxiliary heating means to flow auxiliary heated coolant fluid to the subsystem in the heating mode of operation.

12. The heat pump system of claim 11 wherein the coolant fluid subsystem further includes a third circulation conduit means to supply heated coolant fluid to the subsystem during the heating mode of operation by selective operation of the second pump with the auxiliary heating means.

13. The heat pump system of claim 12 wherein the thermostatic coolant fluid control means is in fluid connection with the recouperator means to receive through a first inlet and control at least a portion of the coolant fluid flow in response to the temperature of the coolant fluid, and the thermostatic coolant fluid control means is further in fluid connection at its outlet with the first pump means to convey coolant fluid to the engine and thereby complete the first loop circuit.

14. The heat pump system of claim 13 wherein the coolant fluid subsystem further includes a coolant fluid tank means in fluid connection with a second inlet of the thermostatic control means to supply coolant fluid to the engine means as required to warm or cool the engine means by modulation of coolant fluid flow through the thermostatic control means.

15. The heat pump system of claim 1 wherein the coolant fluid subsystem further includes:

a recouperator means in fluid connection with the heat engine to receive coolant fluid flow from the engine;

a thermostatic coolant fluid control means in fluid connection with the recouperator means to receive through a first inlet and control at least a portion of the coolant fluid flow in response to the temperature of the coolant fluid, the thermostatic coolant fluid control means further in fluid connection with the first pump means to convey coolant fluid to the engine and complete a first loop circuit operable by the control of the thermostatic means to warm or cool the engine more rapidly when the subsystem operation will benefit therefrom;

a coolant fluid tank means in fluid connection with a second inlet of the thermostatic control means to supply coolant fluid to the engine means as required to warm or cool the engine means by modulation of coolant fluid flow through the thermostatic control means;

a switching valve means in connection with the recouperator means to receive coolant fluid, and selectively in connection with at least one waste heat recovery component to flow coolant fluid thereto in at least one mode of operation;

a second pump means in the connection between switching valve means and the waste heat recovery component to supply coolant fluid through the waste heat recovery component to an auxiliary heating means, with a second circulation conduit means connecting the auxiliary means to the tank means to flow auxiliary heated coolant fluid to the subsystem in the heating mode of operation; and a third circulation conduit means connecting the tank means to the second pump through a check valve to supply heated coolant fluid to the subsystem during the heating mode of operation by selective operation of the second pump with the auxiliary heating gas burner.

16. The heat pump system of claim 1 comprising:

a recouperator means in fluid connection with the heat engine to receive coolant fluid flow from the engine;

a thermostatic coolant fluid control means in fluid connection with the recouperator means to receive through a first inlet and control at least a portion of the coolant fluid flow in response to the temperature of the coolant fluid, the thermostatic coolant fluid control means further in fluid connection with the first pump means to convey coolant fluid to the engine and complete a first loop circuit, operable by the control of the thermostatic means to warm or cool the engine more rapidly when the subsystem operation will benefit therefrom;

a switching valve means in fluid connection with a second inlet of the thermostatic control means to supply coolant fluid to the engine means as required to warm or cool the engine means by modulation of coolant fluid flow through the thermostatic control means, and, further, selectively in fluid connection with at least one waste heat recovery component to receive fluid flow therefrom in at least one mode of operation, a second pump means and an auxiliary heating means in fluid connection between the recouperator and the switching valve means connected by a second circulation conduit means to flow auxiliary heated coolant fluid to the subsystem in the heating mode of operation; and a third circulation conduit means connecting the second circulation conduit means at a position downstream of the heat recovery component, second pump means, and auxiliary heating means to the recouperator through a check valve means, to supply heated coolant fluid to the subsystem during the heating mode of operation by selective operation of the second pump means and the auxiliary heating means.

17. A method for purging a heat engine driven heat pump system having a refrigeration cycle heat pump compressor driven by a heat engine means; a coolant fluid circulation subsystem including conduit means for fluid circulation, at least one waste heat recovery component, a first pump means to convey coolant fluid under pressure through the circulation conduit means, engine, and heat recovery component, and an overflow reservoir; said method for purging comprising the steps of:

identifying a plurality of purge points in the coolant fluid circulation subsystem;

providing a plurality of vent lines each extending from ones of the purge points to respective purge valve inlets, at least one purge valve having at least one inlet and at least one outlet, at least one drain conduit means extending from at least one purge valve outlet to the overflow reservoir, a processor means for operating the one purge valve, and a purge pump and return conduit means to convey coolant fluid under pressure from the overflow reservoir into circulation in the subsystem;

automatically venting ones of the purge points to the overflow reservoir, said step of automatically venting including the step of automatically operating at least one vent valve to open ones of the vent lines and purge trapped air and vapor from the purge points;

returning coolant fluid under pressure into circulation in the subsystem to maintain subsystem fluid volume at a desired level.

18. The method of claim 17 wherein the step of automatically venting includes triggering the processor means periodically to sequentially vent the plurality of purge points.

* * * * *